US009246282B1

(12) United States Patent
Sovel et al.

(10) Patent No.: US 9,246,282 B1
(45) Date of Patent: Jan. 26, 2016

(54) ELECTRICALLY CONDUCTING, ENVIRONMENTALLY SEALING, LOAD TRANSFERRING CABLE TERMINATION FITTING

(71) Applicants: James E. Sovel, Panama City Beach, FL (US); Jacob Cornman, Panama City Beach, FL (US); Meir Gershenson, Panama City Beach, FL (US)

(72) Inventors: James E. Sovel, Panama City Beach, FL (US); Jacob Cornman, Panama City Beach, FL (US); Meir Gershenson, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 176 days.

(21) Appl. No.: 13/894,848

(22) Filed: May 15, 2013

(51) Int. Cl.
*H01R 4/62* (2006.01)
*H01R 24/38* (2011.01)

(52) U.S. Cl.
CPC ..... *H01R 24/38* (2013.01)

(58) Field of Classification Search
CPC ..... H02G 3/0666; H02G 15/23; H01R 4/62
USPC ..... 174/74 R, 75 C, 88 R
See application file for complete search history.

(56) References Cited

U.S. PATENT DOCUMENTS 1,186,813 A * 6/1916 McFerran ..... F16L 19/0653 285/341
1,909,344 A * 5/1933 Green ..... F16G 11/02 191/44.1
3,184,535 A * 5/1965 Worthington ..... H01R 4/08 174/90
4,035,007 A * 7/1977 Harrison ..... F16L 13/004 285/381.2
6,538,203 B1 * 3/2003 Nolle ..... H01R 4/62 174/84 C
7,311,553 B2 * 12/2007 Tamm ..... H01R 4/20 439/584
7,874,881 B1 * 1/2011 Sosa ..... H01R 4/188 439/877

* cited by examiner

*Primary Examiner* — Chau N Nguyen
(74) *Attorney, Agent, or Firm* — James T. Shepherd

(57) ABSTRACT

A corrosion resistant, environmentally sealing, swaged-on conductive fitting for a coaxial cable is provided. The cable has inner and external conductors. A stepped intermediate ring is fitted over exposed lengths of trimmed layers of the inner conductor and abuts a trimmed end of a jacket that covers the inner conductor. An inner ring having a socket with interior recessed circumferential grooves is placed over and swaged against the intermediate ring so that the grooves overlap the cable's jacket and are embossed into and anchor the inner ring to the jacket. The external conductor is anchored between the inner ring and an outer ring when the outer ring is swaged. An electrically conductive path is provided from said external conductor through the inner and intermediate rings to the inner conductor without exposing the inner conductor to a corrosive environment.

14 Claims, 4 Drawing Sheets

ELECTRICALLY CONDUCTING, ENVIRONMENTALLY SEALING, LOAD TRANSFERRING CABLE TERMINATION FITTING

STATEMENT OF GOVERNMENT INTEREST

The invention described herein may be manufactured and used by or for the Government of the United States of America for Governmental purposes without the payment of any royalties.

BACKGROUND OF THE INVENTION

1. Field of the Invention

The present invention relates generally to a swaged-on fitting, and in particular to an electrically conductive termination fitting that connects an inner conductor to an external conductor on a cable, and simultaneously coaxially anchors the external conductor, where the external conductor functions as an electrode.

2. Prior Art

Known prior art cable connections include RCA connectors, where a wire is connected to a plug having an electrical socket covered with an insulator, wherein the wire is typically soldered in position in the coaxial electrical socket. Sometimes, instead of soldering, the electrical socket is crimped against the wire. Large wires do not lend themselves to soldering if the wire is insulated, as the insulation is typically a thermoplastic like PVC. The plug can then be plugged into another socket-like receptacle that has a spring loaded wall, which provides friction between the plug and the socket-like receptacle. A second wire is in electrical contact with the socket-like receptacle.

The prior art does not read on plugs that themselves are also an electrical socket, where the wire is inserted directly into the plug and there is no insulator, other than the wires.

In another type of connection, the wire is prepared by stripping back the insulation, and the wire itself acts as the plug. Probably the most common electrical connection is made through a junction box, and some of these connections do not require a plug or screw, but typically the wire is stiff enough that it can act as a plug, and therefore limited in gauge and current. Flexibility requires wires that are combination of individual wire strands, and solder is often employed to improve contact. Smashing out the multi-strand wire with a crimping tool or screw generally improves electrical contact; this requires that the wire be bent. Cables with a core strength member do not lend themselves to any of the previously discussed connectors.

Applicant is unaware of any prior art that reads on a swaged-on fitting that not only appends an external conductor, but terminates only a portion of a coaxial cable, enabling a strength member to pass through the fitting.

SUMMARY OF THE INVENTION

The invention is a corrosion resistant swaged-on conductive fitting for a coaxial cable having an inner conductor that is sealed from the environment by a cable jacket, and an external conductor that is exposed to the environment, and where the coaxial cable has a contiguous strength member that passes through the fitting substantially intact. In the broadest scope, the conductive fitting has an intermediate ring that functions as an electrical receptacle with an aperture for the pass-through of the strength member, where the receptacle receives and is in electrical contact with the inner conductor of a prepared end of the inner conductor. The intermediate ring also functions as an electrical plug that can be plugged into an electrical socket, and, in one variation, an inner ring functions as the electrical socket with a center opening for the pass through of the strength member. The intermediate ring is essentially nested in a socket portion of the inner ring. The inner ring is swaged onto the intermediate ring and the jacket covering the inner conductor, therein forming a connecting terminal on the cable, where the connecting terminal has the extending coextensive core strength member.

The inner ring, in combination with an outer ring, can be used to provide an anchoring and electrical connection of an external conductor to the inner conductor. The external conductor, which typically is an electrode having a plurality of exposed wires, overlays at least a portion of the inner ring; and the external conductor is anchored between the outer ring and the inner ring. In the second swaging, the outer ring is swaged, anchoring the external conductor between the outer ring and the inner ring. The swaging establishes excellent electrical contact with the inner ring. The connecting terminal is not only conductive, but it is also load bearing. The combined first and second swagings immobilize the conductors and rings, and provides conductivity to the conductors through the intermediate ring and the inner ring, while at the same time environmentally protecting the inner conductor and other components.

The invention can be significantly more complicated, in part because the connections are used in salt water, which is corrosive and conductive. Another factor that complicates the connection is that the cable has a strength member at its core, and the strength member traverses through the conductive fitting without being cut, crimped or even bent. The strength member remains totally intact.

One of the solutions is that the cable jacket is typically made of polytetrafluoroethylene (PTFE), where PTFE is selected in large part because it has excellent resistance to heat and oxidation. However PTFE has a low coefficient of friction, and it has to be gripped without piercing the cable jacket. The inner ring has interior load holding grooves that are in contact with the jacket, and the first swaging embosses the jacket creating a plurality of embossed ribs in the jacket, such that the grip is both frictional and the grip has an interference fit between the grooves and the plurality of embossed ribs, where an embossed rib partially protrudes into to an opposing recessed groove, therein providing a water tight seal and resistance to translational movement and rotational movement.

BRIEF DESCRIPTION OF THE DRAWINGS

The foregoing invention will become readily apparent by referring to the following detailed description and the appended drawings in which.

DETAILED DESCRIPTION OF THE INVENTION

The illustrated embodiment of the invented conductive fitting enables electrical conduction between an external conductor and an inner conductor of a cable, while environmentally protecting the inner conductor. The illustrated conductive fitting provides isolation of the cable's components, where the cable's components include an insulating jacket, coverings, and corrosion resistant fittings. The inner conductor is covered by the insulating jacket of the coaxial cable having a core strength member, which typically is a wire rope. The inner conductor and the external conductor never come into direct contact with each other. Conductance is through an inner ring and an intermediate ring that is axially seated in the inner ring, similar to a plug in receptacle. Both rings are conductive and in excellent electrical contact, so there is little electrical resistance. The external conductor is in electrical contact with an exterior side of a wall of the inner ring. The inner conductor is in electrical contact with an interior side of a wall of the intermediate ring, so there is an electrical path from the external conductor through the inner ring, through the intermediate ring, and finally into the inner conductor of the coaxial cable.

Figure 1:
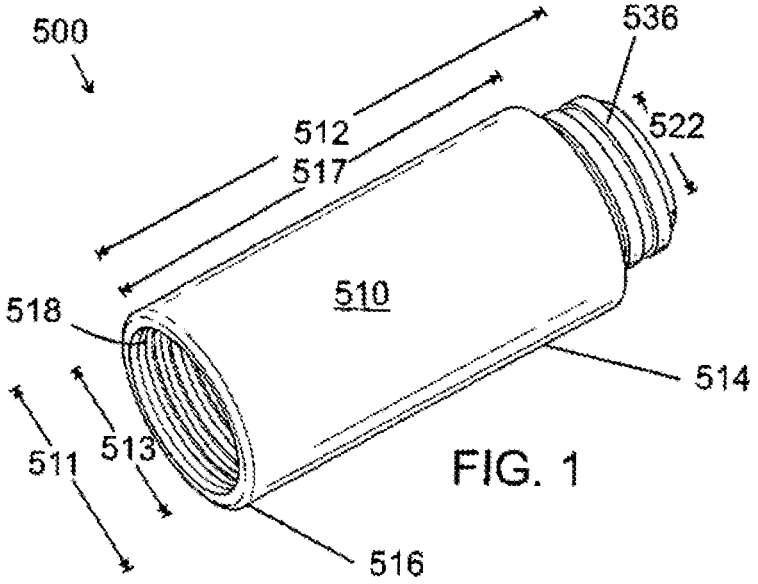
FIG. 1 is a perspective view of an inner ring of a swaged-on, corrosion resistant, sealing, electrically conducting, load transferring termination fitting.
Figure 2:
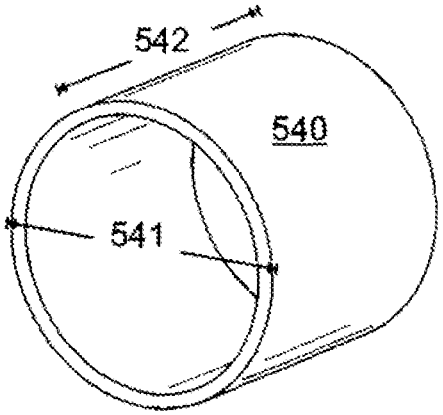
FIG. 2 is a perspective view of an outer ring of a swaged-on, corrosion resistant, sealing, electrically conducting, load transferring termination fitting.
Figure 3:
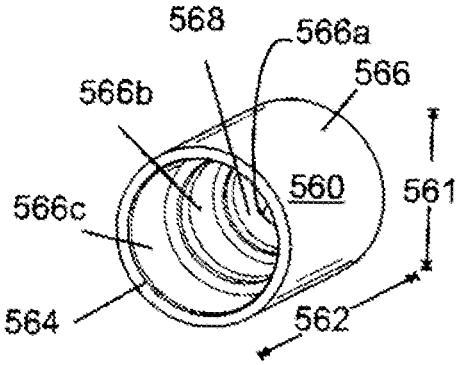
FIG. 3 is a perspective view of an intermediate ring of swaged-on, corrosion resistant, sealing, electrically conducting, load transferring termination fitting.
Figure 4:
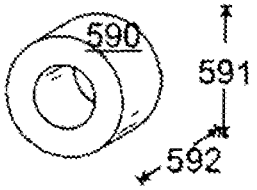
FIG. 4 is a perspective view of a rubber tube of the fitting.

The conductive fitting 500 typically has three main elements: An inner ring 510 as shown in FIG. 1, an outer ring 540 as shown in FIG. 2, and an intermediate ring 560 as shown in FIG. 3. The inner ring and the intermediate ring are composed of metallic, electrically conducting materials. The fitting 500 also includes a rubber tube 590, illustrated in FIG. 4, which has a length 592 and an outside diameter 591.

Figure 6:
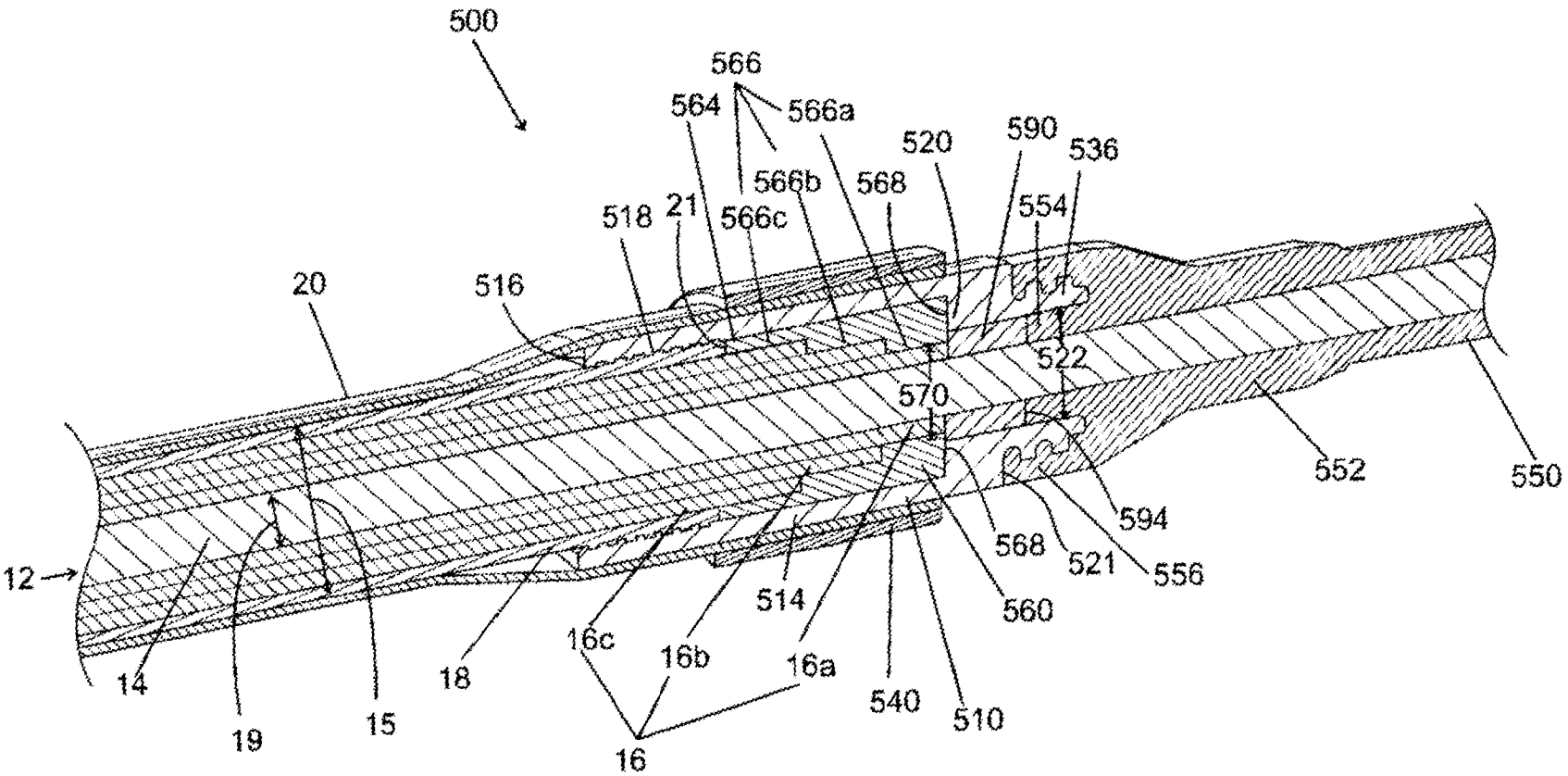
FIG. 6 is a substantially longitudinal cross-sectional view of FIG. 5.

The outer ring 540 has the largest outside diameter 541, the inner ring 510 has the next largest outside diameter 511 and a length 512 that is longer than the outer ring length 542. The intermediate ring 560 has an outside diameter 561 that is equal to or slightly smaller than the inside diameter 513 of the inner ring 510 to permit the inner ring to snugly fit over the intermediate ring, and a length 562 that is similar to the length 542 of the outer ring 540. As is illustrated in FIG. 6 and will become evident from the below description, the outside diameter 561 of the intermediate ring is substantially the same as the diameter 15 of the cable 12 so that a trimmed end 21 of cable jacket 18 will abut snugly and substantially flush with the mouth 564 of the intermediate ring. As will also become evident from the below description and as illustrated in FIG. 6, the inside diameter (not shown) of the outer ring 540 is substantially equal to, or slightly larger than, the outside diameter of the inner ring 510 plus twice the thickness of the external conductor 20 to permit the outer ring to snugly fit over the portion of the external conductor that covers the inner ring.

The inner ring substantially includes a deep socket 514 and a ribbed annular stem 536. The deep socket 514 has an entrance 516 with an inside diameter 513, and a length 517. The inside diameter 513 is only slightly larger than the outside diameter 15 of the S-cable 12 illustrated in FIG. 7 and, as has been previously discussed, the inside diameter 513 of the inner ring is only slightly larger than the outside diameter 561 of the intermediate ring 560. Inside socket 514, proximate to and extending away from the entrance 516 there are a plurality of sealing grooves 518. When the fitting 500 is swaged, the sealing grooves 518 emboss the cable jacket 18 as shown in FIG. 6 and described below. The cable jacket 18 is non-conductive and seals the inner conductor 16 from the outside environment, including potentially corrosive salt water. When swaged, grooves 518 do not pierce the jacket 18, thereby preserving the jacket's non-conducting and sealing characteristics. To prevent piercing, the grooves are recessed into the interior of socket 514, i.e., they are not ribbed. The socket 514 terminates in a partially occlusive base 520 (see FIG. 6) having a center opening 522 that is the inside diameter of the ribbed annular stem 536.

The ribbed annular stem 536 extends outwardly from the base 520. The ribbed annular stem 536 is coaxial with socket 514. The center opening 522 of the ribbed annular stem 536 is larger than a thickness 19 of the strength member 14 (see FIG. 6 and FIG. 7, but smaller than the diameter 15 of the S-cable 12.

The relationship of the elements is illustrated in the cross-sectional view in FIG. 6. The strength member 14 is contiguous, and it traverses through the conductive fitting 500, largely undiminished by the conductive fitting 500. Referring also to FIG. 3, the intermediate ring 560 is substantially a socket with a uniform outside diameter 561. As shown in FIG. 6, the intermediate ring 560 is essentially plugged into the inner ring 510 until it reaches the base 520. The intermediate ring 560 has a stepped circular wall 566 that becomes thicker in stepped increments, 566*c*,566*b*,566*a* moving from the mouth 564 of the intermediate ring toward the bottom 568, where the bottom 568 has a center aperture 570.

Figure 7:
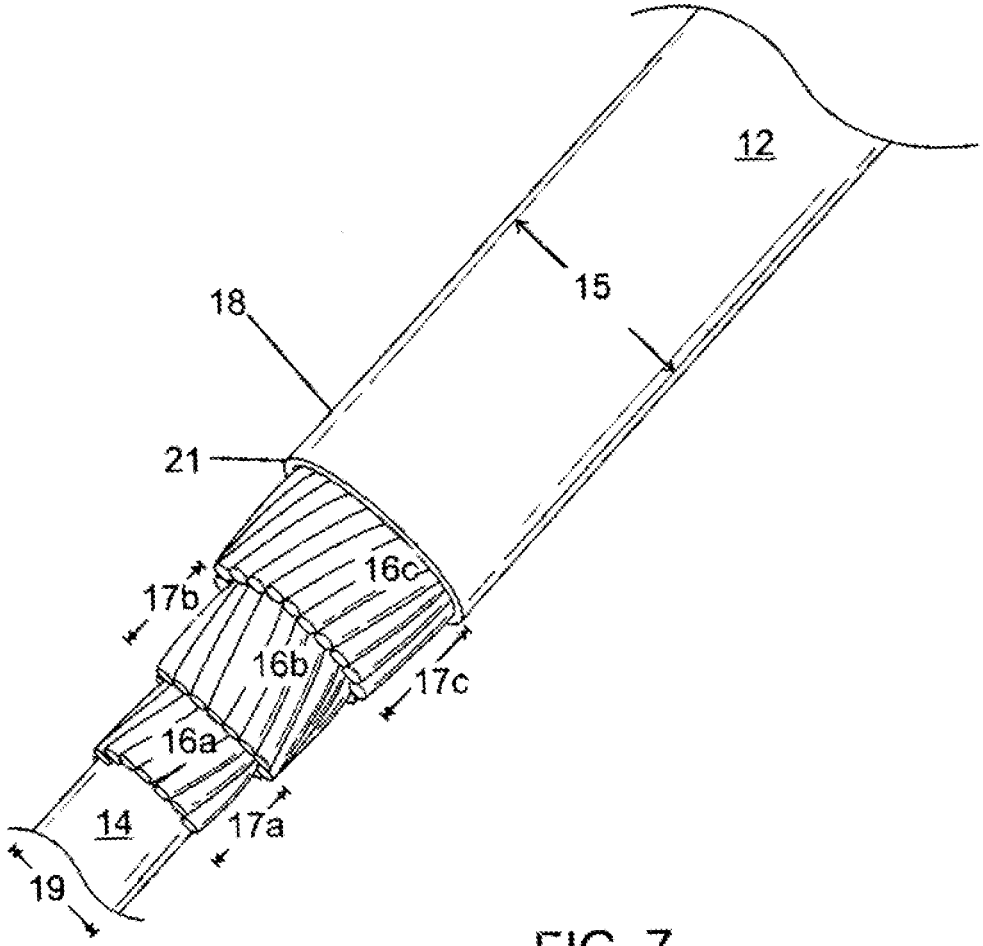
FIG. 7 is a substantially side partial view of an S-cable that has been prepared to fit the intermediate ring on the cable flush with the jacket and layers of the inner conductor, wherein the jacket and layers of the inner conductor are trimmed in a step-like fashion to expose the inner conductor layers, and to match the inside geometry of the intermediate ring, which has a stepped inside diameter.

Referring to FIGS. 6 and 7, the jacket 18 and layers of the inner conductor 16 are trimmed in a step-like fashion to expose the layers of the inner conductor so that they will fit into the intermediate ring 560, which has a stepped inside diameter. As shown in FIG. 6, inner conductor 16 comprises a plurality of wire layers (3 layers in the illustrated example). An innermost layer 16*a* of the inner conductor is closest to the strength member, and therefore it must be the longest overall, such that an innermost length 17*a* (see FIG. 7) of the innermost layer 16*a* can extend into the center aperture 570 of the bottom 568 of the intermediate ring 560. A middle layer 16*b* of the inner conductor 16 is trimmed shorter than innermost layer 16*a*, exposing the innermost length 17*a*. An outermost layer 16*c* of the inner conductor 16 is trimmed shorter than the middle layer 16*b*, exposing a middle length 17*b*. The cable jacket 18 is trimmed even shorter, exposing an outermost length 17*c*. The intermediate ring is positioned by sliding the intermediate ring 560 toward the trimmed cable over the strength member 14, which is trimmed of inner conductor 16 as shown in FIG. 7 and explained above. The innermost layer 16*a* extends into the center aperture 570 of the bottom 568 of the intermediate ring 560. The center aperture 570 is coaxial with the center opening 522 of the inner ring 510. The inner ring 510 is then similarly slid over the strength member 14, encompassing the intermediate ring, such that the base 520 of the inner ring 510 abuts the bottom 568 of the intermediate ring 560. The sealing grooves 518 should reach well past the trimmed end 21 of the cable jacket 18.

The inner ring 510 is then swaged onto the cable 12. The swaged-on inner ring 510 causes the sealing grooves 518 to emboss the cable jacket 18. The embossed jacket, after swaging, has a plurality of embossed ribs, each rib partially protruding into an opposing recessed groove 518, therein providing both frictional resistance and an interference fit and thereby providing resistance to translational movement and rotational movement of cable 12 relative to fitting 500.

Figure 5:
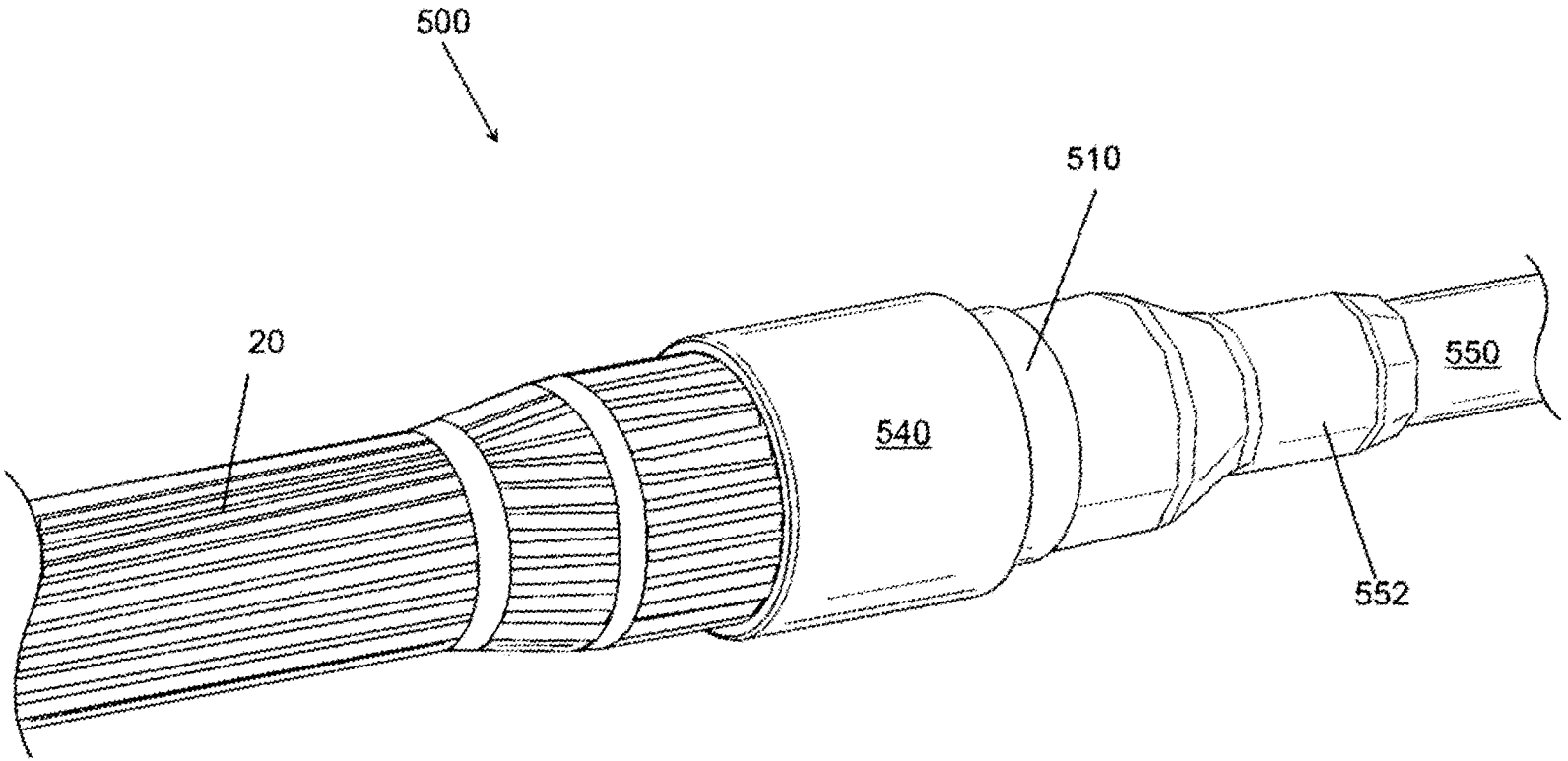
FIG. 5 is a substantially side partial view of a minesweeping cable fitted with the illustrated fitting, wherein the fitting is anchoring an end of an external electrode to the cable, and the electrode is in electrical contact through the fitting with the cable's inner conductor.

In the illustrated embodiment, an external conductor 20 is anchored to the S-cable 12 between the outer ring 540 and the inner ring 510. The external conductor 20, which comprises a plurality of exposed wires, is positioned so that at least some of the wires overlay the inner ring 510 with their ends substantially aligned with the bottom 568 of intermediate ring 560. The outer ring is slid over the external conductor 20 and is similarly aligned with the intermediate ring. The outer ring 540 is swaged, anchoring the external conductor 20 between the outer ring 540 and the inner ring 510. In the exemplary embodiment of the invention illustrated and described herein, the external conductor functions as an electrode of a magnetic influence minesweeping cable, which is in contact with salt water and can be submerged several hundred feet. The external conductor 20 has no insulation and is exposed to the seawater environment, as illustrated in FIG. 5. The inner conductor functions as the other electrode of the minesweeping cable, which is sealed from the environment in the area of fitting 500.

The center aperture 570 of the intermediate ring has an inside diameter that is smaller than the inside diameter of the center opening 522, and this can be advantageously used to help insulate the cable 12. The short rubber tube 590 can be slid over the strength member 14, and pushed into the center opening 522 of annular stem 536 of the inner ring 510 until the rubber tube 590 abuts the bottom 568 of the intermediate ring 560. The short rubber tube 590 has an inside diameter that is substantially the same size as the strength member's outside diameter 19. The diameter can be temporarily increased by swelling the short rubber tube 590 in solvent to facilitate movement of the rubber tube over the strength member. Additionally, a heat shrinkable rubber is easier to work with. The rubber tube provides a backup seal and an insulator between the strength member 14 and inner ring 510. As shown in FIG. 6, the rubber tube 590 typically does not fill an entire length of the annular stem 536, providing a space for an inside portion 554 of a molded polymeric covering 550 to attach to the ribbed stem 536. The molded polymeric covering 550 has an outside portion 556 that covers the ribs and abuts the exterior 521 of the base 520 of inner ring 510, providing a substantially sealedly flush covering. A thicker tapering region 552 provides flexural support of the molded polymeric covering 550 and prevents sharp bending of the strength member 14, which can weaken the strength member. Polyurethane has been found to be a suitable polymer, but many other rubber materials could be suitable. Prior to molding covering 550 to the ribbed annular stem 536, the ribbed annular stem 536 is preferably sandblasted and coated with a primer to improve the bond of the molded polymeric covering 550 to the ribbed annular stem 536.

It is anticipated that not all applications of the invented conductive fitting 500 will require anchoring an external conductor, and in those applications the outer ring would not be required, and therefore only swaging of the inner ring would be required.

The composition of the wires of the layers of the inner conductor 16 is advantageously selected to include a conductive metal that is relatively soft, such as a soft grade of aluminum. The external conductor 20, when used as an anode electrode, has been found to have improved resistance to corrosion if it is made of titanium-clad copper with mixed metal oxides, and this influences the composition of conductive materials that come into direct and indirect contact with the external conductor 20. The composition of the external conductor 20 affects the selection of the materials used in the invented rings 510,540,560. If the preferred composition of titanium-clad copper with mixed metal oxides is used in the external conductor 20, then the inner ring 510 preferably has a titanium-based composition with platinum plating. The outer ring 540 also preferably has a titanium-based composition. The intermediate ring 560 would preferably have an aluminum-based composition. It can also be plated, for example with tin to reduce corrosion.

It has been found that the intermediate ring enables improved conductivity with the inner conductor, where the inner conductor is composed of a softer aluminum, and the intermediate ring is composed of a harder aluminum that is plated with tin. When the inner ring is swaged, the softer aluminum inner conductor deforms against the harder aluminum intermediate ring, forming a low resistance electrical contact. A good contact between the aluminum intermediate ring and an inner ring comprised of titanium plated with platinum provides satisfactory (but not as good) electrical properties, but the combination provides excellent resistance to corrosion. The aluminum intermediate ring has the added advantage that during swaging it swages similar to the cable.

From FIG. 7, it is apparent that contact between the inner conductor 16 and the intermediate ring 560 has been optimized. The existing cable jacket 18 provides insulation against corrosion, and is functional at relatively high temperatures. PTFE can operate effectively, maintaining its shielding properties, at up 200° C. The S-cable 12 is prepared to fit into the intermediate ring 560, with the end 21 of the cable jacket abutting the mouth 564 of the intermediate ring 560 (as shown in FIG. 6). The jacket 18 and layers 16*a*,16*b*, 16*c* of the inner conductor 20 are trimmed in a step-like fashion to expose the underlying lengths 17*a*,17*b*,17*c* of inner conductor layers, where the trimmed inner conductor 16 matches the inside geometry of the intermediate ring 560.

As previously discussed, the outside diameter of the intermediate ring 560 is slightly smaller than the inside diameter of the inner ring 510 before swaging. After the first and second swaging the outside diameter 561 of the intermediate ring 560 and the inside diameter 513 of the inner ring 510 are nearly the same.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. A fitting for anchoring and electrically connecting an external conductor to an internal conductor of a coaxial cable, where the coaxial cable includes an internal continuous strength member, the internal conductor which comprises a plurality of wire layers trimmed to different lengths, and a non-conducting, environmentally sealing jacket trimmed shorter than the shortest trimmed wire layer, said fitting comprising:

an intermediate ring having a mouth at one end and a bottom having a center aperture at an opposite end, said intermediate ring having a stepped inner circular wall wherein each step is sized to accept and abut against an end of a corresponding trimmed layer of the internal conductor, and wherein said mouth of said intermediate ring has substantially the same outside diameter as the diameter of the coaxial cable;

an inner ring having a socket with an entrance at one end, a base having a center opening at an opposite end, and a plurality of grooves extending away from said entrance inside said socket, wherein said socket has an internal diameter substantially equal to said outside diameter of said mouth of said intermediate ring to enable said socket to snugly fit over said intermediate ring, and wherein said center opening of said base has a diameter larger than the diameter of said center aperture of said intermediate ring;

an outer ring having an inside diameter substantially equal to the outside diameter of said inner ring plus twice the thickness of the external conductor to enable said outer ring to snugly fit over the external conductor when the external conductor overlays said inner ring; and a rubber tube having an inside diameter substantially equal to the diameter of the strength member of the coaxial cable to enable said rubber tube to snugly fit over the strength cable, and an outside diameter substantially equal to said diameter of said center opening to enable said rubber tube to fit snugly inside said center opening;

wherein said intermediate ring is configured to snugly fit over the inner conductor so that said steps will abut against the ends of the trimmed wires and said mouth will abut snugly and substantially flush with the trimmed end of the cable jacket;

wherein said inner ring is configured to snugly fit under the external conductor and over said intermediate ring and the cable jacket so that said grooves will be adjacent to the cable jacket and said base of said inner ring will abut against said bottom of said intermediate ring;

wherein said rubber tube is configured to snugly fit over the strength member and inside said center opening of said inner ring to abut against said bottom of said intermediate ring;

wherein said outer ring is configured to snugly fit over the portion of the external conductor that overlays said inner ring so that, when swaged, said outer ring will compress the external conductor against said inner ring, the grooves of said inner ring will compress against and emboss into the cable jacket, and said inner ring will compress said intermediate ring against the inner conductor.

2. The fitting of claim 1, wherein said grooves are shallower than the thickness of the cable jacket so as to prevent said inner ring from piercing through the cable jacket during swaging.

3. The fitting of claim 2, wherein said intermediate ring and said inner ring are composed of a metallic, electrically conducting material.

4. The fitting of claim 2, wherein said outer ring has a titanium-based composition, said inner ring has a titanium-based composition with platinum plating, and said intermediate ring has an aluminum-based composition.

5. The fitting of claim 4, wherein said intermediate ring is plated with tin.

6. The fitting of claim 1, wherein said inner ring also has a ribbed annular stem extending outwardly from said base, said stem being coaxial with said socket and having an inside diameter equal to the diameter of said center opening.

7. A magnetic influence minesweeping cable, comprising:

a continuous strength member;

an inner conductor surrounding said strength member, said inner conductor comprising a plurality of layers of wires, wherein said layers of wires are trimmed to progressively shorter lengths so that the layer closest to said strength member is the longest layer and the layer farthest from said strength member is the shortest layer;

a non-conducting, environmentally sealing jacket surrounding said inner conductor, wherein said jacket is trimmed to be shorter than the shortest layer of said inner conductor;

an intermediate ring having a mouth at one end, a bottom having a center aperture at an opposite end, and a stepped inner circular wall, wherein said intermediate ring wraps around and is compressed against said inner conductor so that each step accepts and abuts against an end of a corresponding trimmed layer of said internal conductor and said mouth abuts flush against the trimmed end of said jacket;

an inner ring having a socket with an entrance at one end, a base having a center opening with a diameter that is larger than the diameter of said center aperture at an opposite end, and a plurality of grooves extending away from said entrance inside said socket, wherein said inner ring wraps around and is compressed against said intermediate ring and said jacket so that said grooves are embossed into said jacket and said base abuts said bottom of said intermediate ring;

an external conductor encasing said jacket and said inner ring;

an outer ring wrapped around and compressed against said external conductor in the region where said external conductor encases said inner ring; and a rubber tube wrapped around said strength member and sealedly inserted into said center opening of said inner ring, said rubber tube having a first end abutting said bottom of said intermediate ring.

8. The cable of claim 7, wherein said grooves are shallower than the thickness of said cable jacket and said inner ring does not pierce through said cable jacket.

9. The cable of claim 8, wherein said intermediate ring and said inner ring are composed of a metallic, electrically conducting material.

10. The cable of claim 7, wherein said inner ring also has a ribbed annular stem extending outwardly from said base, said stem being coaxial with said socket and having an inside diameter equal to the diameter of said center opening.

11. The cable of claim 10, further comprising a molded polymeric covering molded around said strength member over a length of said strength member not covered by said inner conductor and said jacket, said covering also sealedly molded around said ribbed annular stem and into said center opening so that said covering sealedly abuts flush against a second end of said rubber tube.

12. The cable of claim 7, wherein said intermediate ring and said inner ring are composed of a metallic, electrically conducting material.

13. The cable of claim 7, wherein said external conductor is composed of titanium-clad copper with mixed metal oxides, said outer ring has a titanium-based composition, said inner ring has a titanium-based composition with platinum plating, said intermediate ring has an aluminum-based composition, and said inner conductor is composed of aluminum.

14. The cable of claim 13, wherein said intermediate ring is plated with tin.

* * * * *